US007317462B2

(12) United States Patent
Lu et al.

(10) Patent No.: US 7,317,462 B2
(45) Date of Patent: Jan. 8, 2008

(54) METHOD FOR LUMINANCE COMPENSATION OF LIQUID CRYSTAL DISPLAY AND ITS DEVICE

(75) Inventors: Yih-Liang Lu, Hsinchu (TW); Yi-Fan Chen, Taichung (TW); Cheng-Jung Chen, Miaoli Hsien (TW); Yuh-Ren Shen, Tainan (TW)

(73) Assignee: Vastview Technologies, Inc. (TW)

( * ) Notice: Subject to any disclaimer, the term of this patent is extended or adjusted under 35 U.S.C. 154(b) by 661 days.

(21) Appl. No.: 10/810,621

(22) Filed: Mar. 29, 2004

(65) Prior Publication Data

US 2005/0212736 A1 Sep. 29, 2005

(51) Int. Cl.
*G09G 3/36* (2006.01)

(52) U.S. Cl. ..... 345/690; 345/89

(58) Field of Classification Search ..... 345/690, 345/89

See application file for complete search history.

(56) References Cited

U.S. PATENT DOCUMENTS 6,043,797 A * 3/2000 Clifton et al. ..... 345/589
6,275,207 B1 * 8/2001 Nitta et al. ..... 345/89
6,611,249 B1 * 8/2003 Evanicky et al. ..... 345/102
6,781,636 B2 * 8/2004 Stessen ..... 348/672
6,839,048 B2 * 1/2005 Park ..... 345/102
6,844,881 B1 * 1/2005 Chen et al. ..... 345/589
6,856,306 B2 * 2/2005 Ito ..... 345/89
6,862,012 B1 * 3/2005 Funakoshi et al. ..... 345/88
6,894,670 B2 * 5/2005 Funakoshi et al. ..... 345/89
6,963,668 B2 * 11/2005 Engeldrum et al. ..... 382/233
6,987,499 B2 * 1/2006 Yamaguchi et al. ..... 345/89
7,084,881 B1 * 8/2006 Chen et al. ..... 345/589
7,092,008 B1 * 8/2006 Bernard et al. ..... 348/180
7,129,456 B2 * 10/2006 Ioka et al. ..... 250/208.1
2006/0071936 A1 * 4/2006 Leyvi et al. ..... 345/589
2006/0170646 A1 * 8/2006 Chou et al. ..... 345/102

* cited by examiner

*Primary Examiner*—Amare Mengistu
*Assistant Examiner*—Sarvesh J Nadkarni
(74) *Attorney, Agent, or Firm*—Lowe Hauptman Ham & Berner, LLP

(57) ABSTRACT

A method for luminance compensation of liquid crystal display includes: measuring the original gamma curve of the panel, setting a target gamma curve, inputting an initial gray level to obtain a luminance corresponding to the target gamma curve, finding the adjusted gray level for expressing the luminance from the original gamma curve, repeating the steps stated above to make a lookup table containing plural groups of proportion array. Then calculating the quantity distribution of input gray levels of images, selecting a corresponding proportion array from the lookup table according to the proportion value between dark level and bright level, substituting the adjusted gray levels in the proportion array for the input gray levels, outputting the adjusted gray levels for adjusting the signal intensity can improve the image quality. The method and the device for luminance compensation can adjust the intensity of input signals to obtain better image quality and suit for the image adjustment of various liquid crystal displays or similar displays.

12 Claims, 6 Drawing Sheets

41 Dark level lookup table

| Initial gray level ($X_1$) | 32 | 64 | 96 | 128 | 160 | 192 | 224 | 256 |
|---|---|---|---|---|---|---|---|---|
| Proportion array set ($X_2$) | 38 | 73 | 107 | 141 | 175 | 208 | 241 | 273 |
| | 44 | 82 | 119 | 155 | 189 | 224 | 257 | 290 |
| | 50 | 92 | 131 | 168 | 204 | 239 | 273 | 307 |
| | 54 | 98 | 138 | 176 | 212 | 248 | 282 | 316 |
| | 57 | 102 | 142 | 181 | 218 | 254 | 289 | 322 |
| | 58 | 104 | 145 | 184 | 221 | 257 | 292 | 326 |

43 Low ↕ High 45 44 47 46

Bright level lookup table 42

| Initial gray level ($X_1$) | 768 | 800 | 832 | 864 | 896 | 928 | 960 | 992 |
|---|---|---|---|---|---|---|---|---|
| Proportion array set ($X_2$) | 757 | 790 | 822 | 855 | 888 | 921 | 955 | 989 |
| | 747 | 780 | 813 | 846 | 880 | 914 | 949 | 985 |
| | 737 | 770 | 804 | 838 | 872 | 907 | 944 | 982 |
| | 727 | 760 | 794 | 829 | 864 | 900 | 938 | 978 |
| | 717 | 751 | 785 | 820 | 856 | 893 | 932 | 974 |
| | 708 | 742 | 776 | 812 | 848 | 886 | 927 | 970 |
| | 698 | 733 | 767 | 803 | 841 | 879 | 921 | 966 |

43' Low ↕ High 45' 44' 47' 46'

Fig.4

METHOD FOR LUMINANCE COMPENSATION OF LIQUID CRYSTAL DISPLAY AND ITS DEVICE

BACKGROUND OF THE INVENTION

1. Field of the Invention

The present invention relates to a method for luminance compensation of liquid crystal display and its device, particularly to a method and a device for luminance compensation, which can adjust the input signal intensity to obtain better image quality and suit for the image adjustment of various liquid crystal displays or similar displays.

2. Description of the Prior Art

Because the liquid crystal display has advantages such as low in electrical consumption, light, small and high in quality etc., it gradually substitutes for the cathode ray tube (CRT) to be the principal product in display industry and suits for digital televisions, notebook computers or computer monitors. But the liquid crystal display has the problems of overlong response time and afterimage due to the liquid crystal molecular properties such as viscosity, dielectricity and elasticity etc. The luminance of the liquid crystal display is not so bright as that of the CRT.

If the input frame is the darker images such as night scene, then the luminance or the contrast of the display would be insufficient so that the viewer can't view the detail of the image. If the input frame is with high contrast, such as the picture photographed with the back to the light, then the gray levels of the brighter and the darker images are more so that the darker region in the frame is more darker, the brighter region in the frame is more brighter, and the two regions in the frame can't display the delicate gradations. There are buttons for luminance and contrast adjustment on the general displays. The viewer can adjust the luminance and the contrast of the image by hand to make images more clear and colors more plentiful, but the adjustment by hand is very troublesome for viewing dynamic images. Because the frame switch of dynamic images is quick and diversified, it is difficult for single luminance and contrast proportion to suit for various images. Therefore, it is needed to enhance the image contrast and make the gradations of the frame clear by the adjustment of the inner parts of the display.

Referring to FIG. 1, it shows a method of gamma adjustment for enhancing images in a prior art. The control device for gray level luminance is installed on the voltage driver of the liquid crystal display. When system judges that the luminance or the contrast of an image is insufficient, the original gamma curve will be risen to be the adjusted gamma curve, i.e. the gamma voltage is increased and the luminance of the display is enhanced, so the contrast and the luminance of the image are improved. However, the technology in the prior art has the following disadvantages:

1. A control device is required to control the voltage in the display, so the power consumption is high.
2. Each display has its characteristic, and the control device can't be adjusted for different panels due to its single function, so the ability to control the image is insufficient.

Therefore, the present invention provides a novel method for luminance compensation and its device to improve the disadvantages stated above.

SUMMARY OF THE INVENTION

The primary object of the present invention is to provide a novel method for luminance compensation in image signal processing, which has considered the characteristic of the panel of the liquid crystal display to improve the image quality of the display.

The secondary object of the present invention is to provide a novel method for luminance compensation, which can quickly obtain adjusted gray levels for expressing the suitable luminance by the simple corresponding of the lookup table.

Another object of the present invention is to provide a novel device for luminance compensation, which can quickly output the adjusted gray levels for improving the image quality of the display by use of the method for luminance compensation stated above and can suit for the panels of various liquid crystal displays.

To achieve the objects stated above, the method of the present invention includes the following steps:

(1) measuring the original gamma curve of a panel;

(2) setting a target gamma curve;

(3) inputting an initial gray level to obtain the luminance corresponding to the target gamma curve, and finding the adjusted gray levels for expressing the luminance from the original gamma curve;

(4) repeating (2) and (3) steps to produce plural groups of initial gray levels and plural groups of adjusted gray levels, and set the plural groups of adjusted gray levels into a proportion array;

(5) repeating (2), (3), and (4) steps to produce plural groups of proportion arrays from the different target curves and make them into a lookup table;

(6) calculating the quantity distribution of the input gray levels of an image;

(7) calculating the dark level proportion and the bright level proportion respectively;

(8) selecting a corresponding proportion array from the lookup table of the dark levels according to the value of the dark level proportion, and substituting the adjusted gray levels in the proportion array for the input gray levels;

(9) selecting a corresponding proportion array from the lookup table of the bright levels according to the value of the bright level proportion, and substituting the adjusted gray levels in the proportion array for the input gray levels; and

(10) outputting the adjusted gray levels for adjusting the signal intensity to improve the image quality.

A device executing the above method according to the present invention includes:

A histogram extraction for receiving image signals and counting the quantity distribution of each input gray level to obtain the distribution state of the gray level;

A lookup table storage unit for storing the lookup table; and

A gray level operation unit for calculating the gray level proportion, taking the gray level proportion into the transfer function to get LUT intensity which corresponds to the proportion array in the lookup table, substituting the adjusted gray levels in the proportion array for the input gray levels, and outputting the adjusted gray levels;

whereby the intensity of the input signals is able to be adjusted and better image quality is able to be obtained.

The present invention will be apparent after reading the detailed description of the preferred embodiments thereof in reference to the accompanying drawings.

BRIEF DESCRIPTION OF THE DRAWINGS

FIG. 4 is a schematic view of the lookup table of the method for luminance compensation of liquid crystal display and its device according to the present invention;

DETAILED DESCRIPTION OF THE PREFERRED EMBODIMENT

Figure 1:
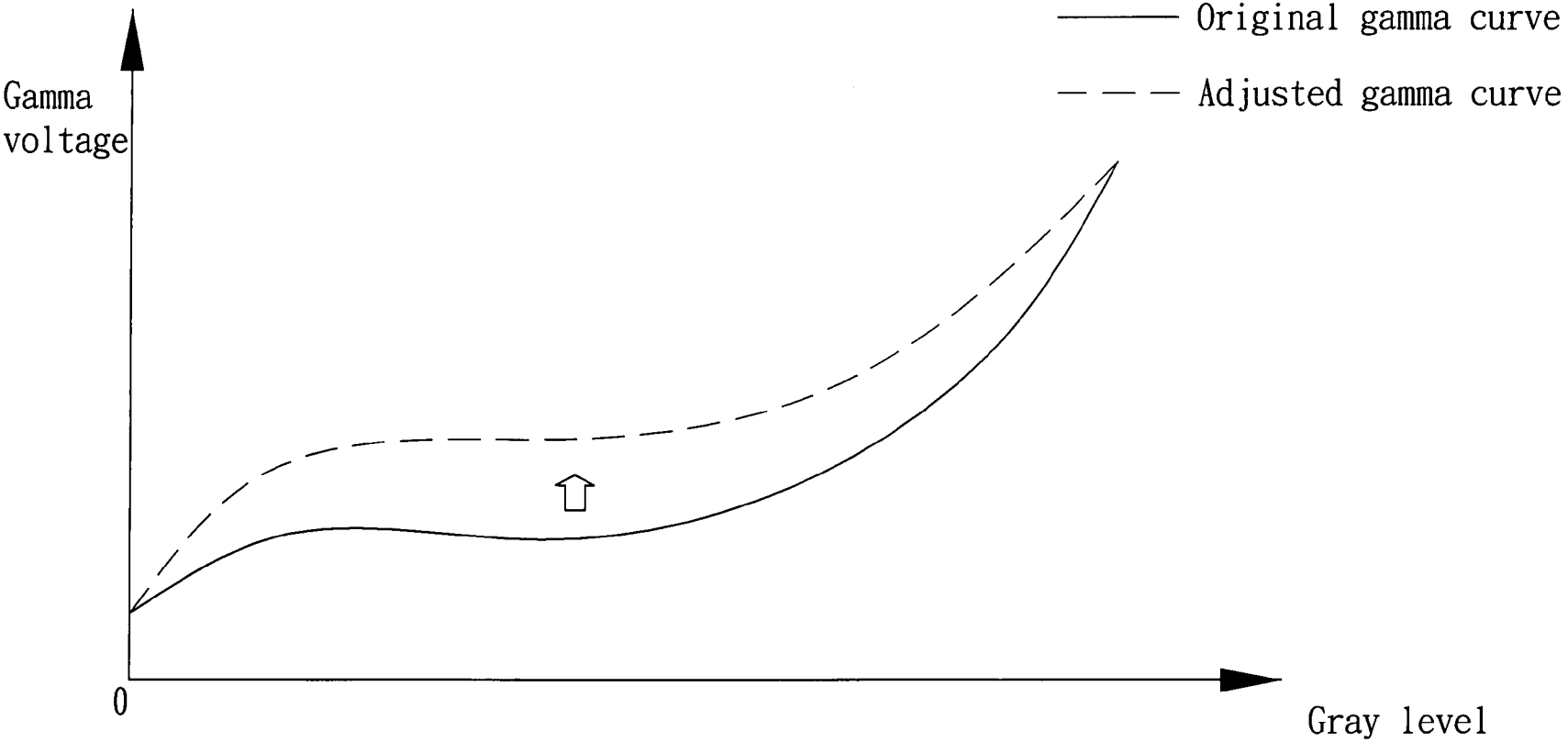
Fig. 1 (Prior Art)
FIG. 1 is a schematic view of a prior method for gamma adjustment, which increases the gamma voltage to enhance image.
Figure 2:
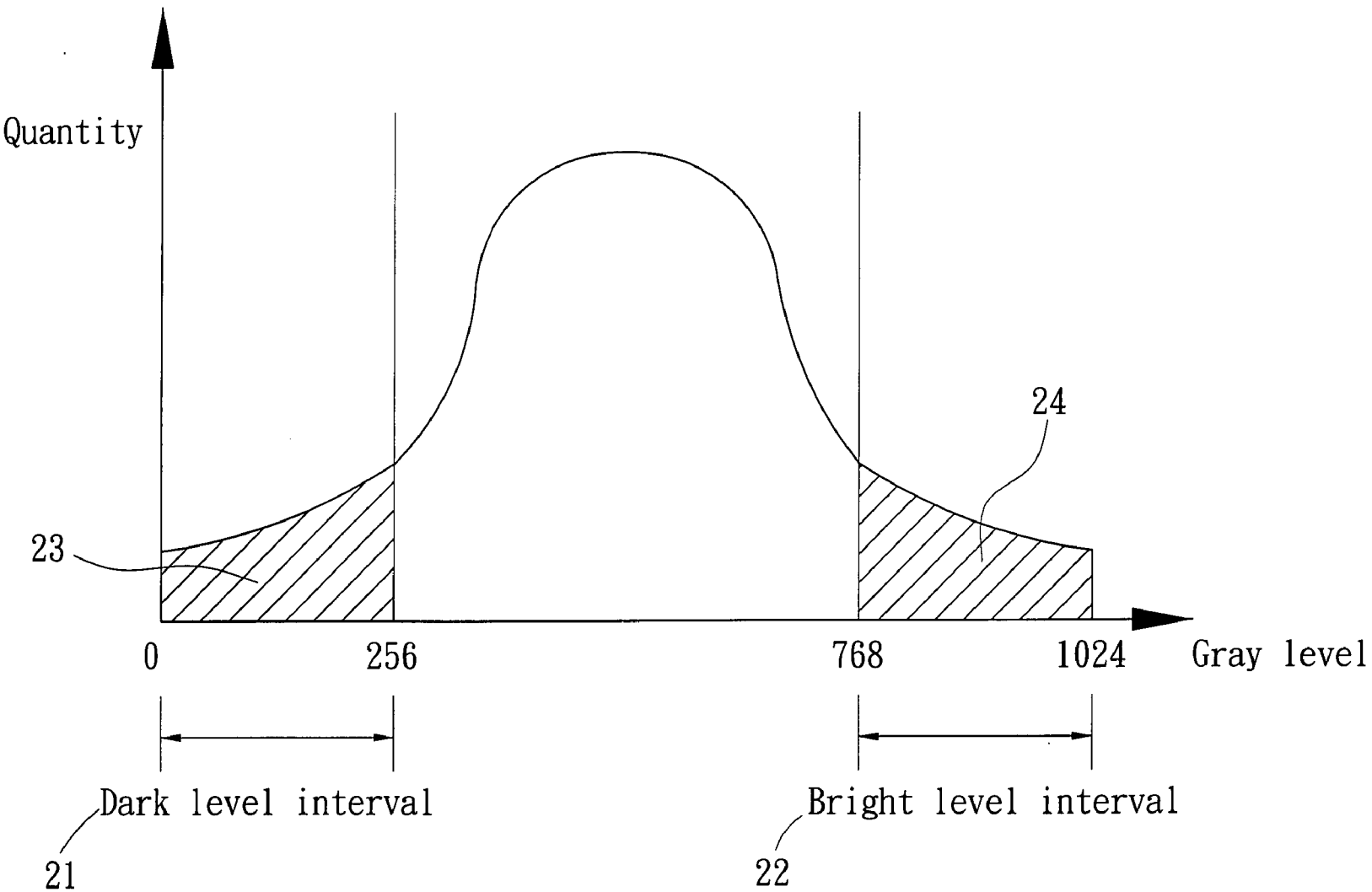
FIG. 2 is a schematic view of the gray level distribution of an image.

Referring to FIG. 2, each image frame has 1024 gray levels for the liquid crystal display of 10 bits. A gray level distribution diagram can be obtained by counting the quantity of each gray level in the image frame, wherein the range from below a specific value in the total gray level range is set as the dark level interval 21, and the range from above a specific value in the total gray level range is set as the bright level interval 22. In the preferred embodiment of the present invention, the range of the dark level interval is the front quarter of the total gray level range, i.e. the gray levels from 0 to 256, and the range of the bright level interval is the rear quarter of the total gray level range, i.e. the gray levels from 768 to 1024. The dark level proportion is defined as the ratio of the gray level quantity 23 in dark level interval 21 to the total gray level quantity and the bright level proportion is defined as the ratio of the gray level quantity 24 in bright level interval 22 to the total gray level quantity.

Figure 3:
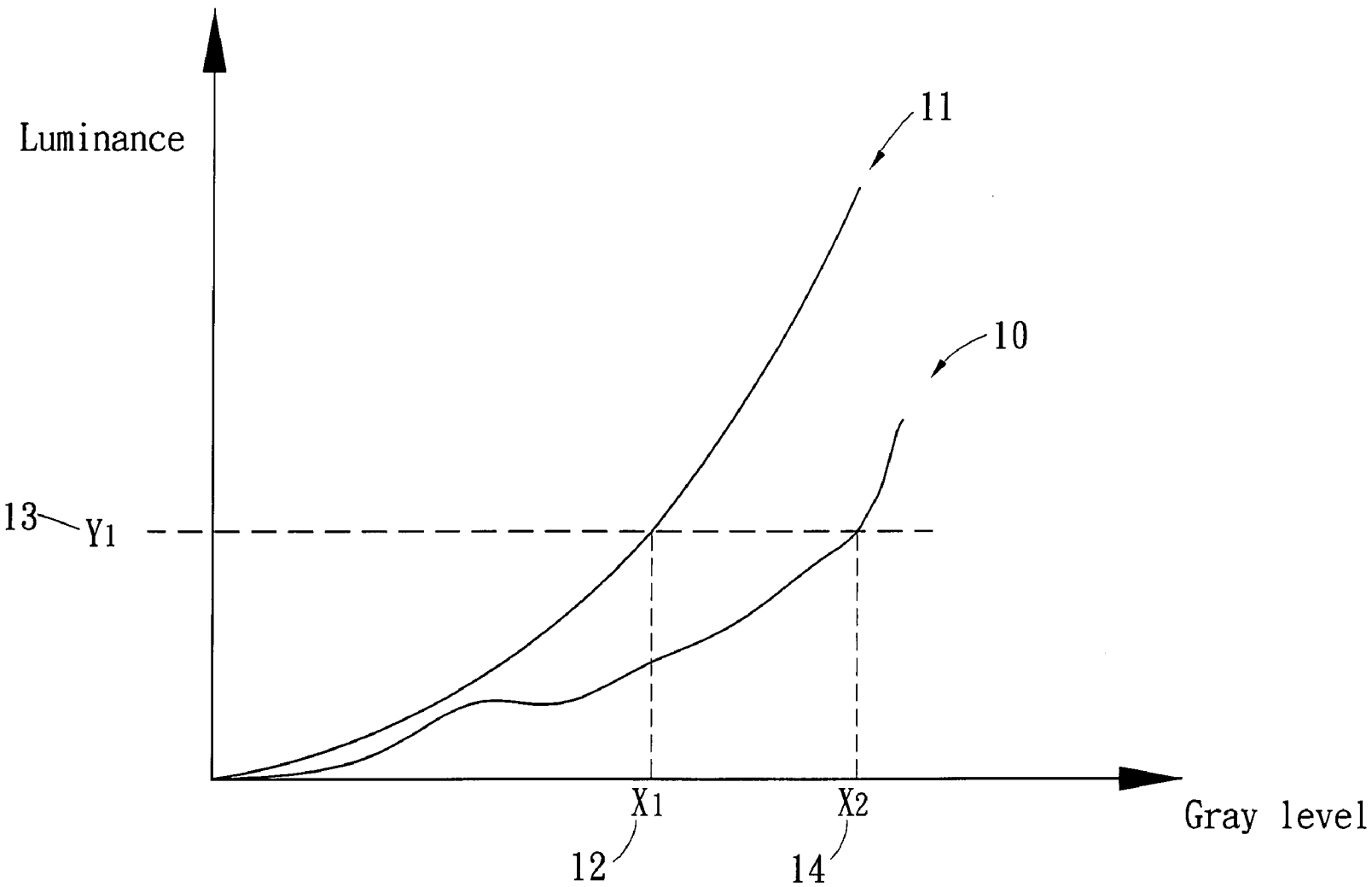
FIG. 3 is a schematic view of the original gamma curve and the target gamma curve of the method for luminance compensation of liquid crystal display and its device according to the present invention.

Referring to FIG. 3, it shows a preferred embodiment for describing how to make a lookup table to which the luminance of the panel of the liquid crystal display is increased accordingly. The method includes the following steps:

(1) measuring the panel of the liquid crystal display to get an original gamma curve 10;

(2) setting a target gamma curve 11;

(3) inputting an initial gray level $X_1$ (mark 12) to obtain the luminance $Y_1$ (mark 13) corresponding to the target gamma curve 11, and finding the adjusted gray level $X_2$ (mark 14) for expressing the luminance from the original gamma curve 10;

(4) repeating (2) and (3) steps to produce plural groups of initial gray levels $X_1$ and plural groups of adjusted gray levels, and combining the plural groups of adjusted gray levels into a proportion array; and (5) repeating (2), (3), and (4) steps to produce plural groups of proportion arrays from different target curves and make them into a lookup table.

As shown in FIG. 4, as for the resolution of the display of 10 bits, the dark level lookup table 41 and the bright level lookup table 42 are respectively made according to the dark level interval and bright level interval, wherein the dark level lookup table 41 selects eight groups of initial gray levels 43 and a proportion array set 44 containing six groups of proportion arrays, and the bright level lookup table 42 selects eight groups of initial gray levels 43' and a proportion array set 44' containing seven groups of proportion arrays. The proportion array sets 44 and 44' contain the adjusted gray levels 46 and 46' corresponding to the initial gray levels 43 and 43', respectively.

After the image data are inputted, the quantity distribution of the input gray levels of the image are calculated to obtain the gray level distribution diagram as shown in FIG. 2, and the dark level proportion and the bright level proportion are calculated, respectively. A corresponding proportion array is selected from the proportion array set 44 in dark level lookup table 41 according to the value of the dark level proportion. The higher the dark level proportion, the stronger the proportion array, as shown by mark 45, which is selected from the proportion array set 44 in the dark level lookup table 41. The corresponding method between the dark level proportion and the proportion array of the dark level lookup table 41 includes: taking the dark level proportion into a dark level transfer function to get a dark level LUT intensity, i.e. dark level LUT intensity=$F_1$ (dark level proportion), wherein the dark level transfer function is an increasing function, i.e. the higher the dark proportion, the larger the dark level LUT intensity, making the dark level LUT intensity correspond to the stronger proportion array in proportion array set 44 and substituting the adjusted gray level 46 of the proportion array for the input gray level.

In a similar manner, a corresponding proportion array is selected from the proportion array set 44' of the bright level lookup table according to the value of the bright level proportion. The higher the bright level proportion, the stronger the proportion array, as shown by mark 45', which is selected from the proportion array set 44' of the bright level lookup table 42. The corresponding method between bright level proportion and the proportion array of the bright level lookup table 42 includes: taking the bright level proportion into a bright level transfer function to get a bright level LUT intensity, i.e. bright LUT intensity=$F_2$ (bright level proportion), wherein the bright level transfer function is an increasing function, i.e. the higher the bright level proportion, the larger the bright level LUT intensity, making the bright level LUT intensity correspond to the stronger proportion array in the proportion array set 44', substituting the adjusted gray level 46' of the proportion array for the input gray level, and last outputting the adjusted gray levels for adjusting the signal intensity to improve the image quality.

Figure 5:
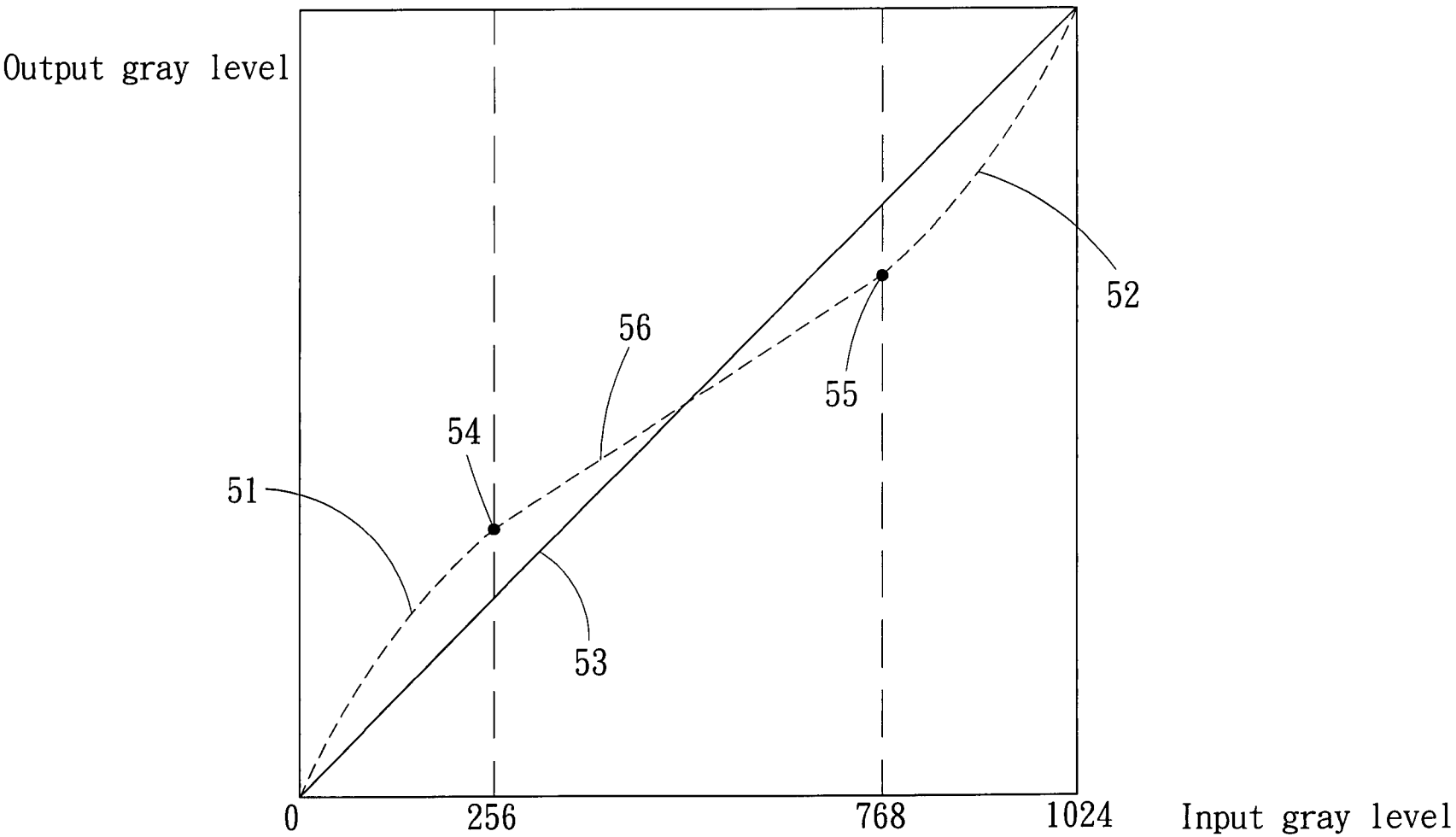
FIG. 5 is a schematic view of the input and the output of the gray levels of the method for luminance compensation of liquid crystal display and its device according to the present invention.

Supposing that the dark level proportion of an image frame corresponds to the proportion array 47 of the dark level lookup table 41, and both the proportion array 47' of the bright level lookup table 42 and the gray levels between the adjusted gray levels can be obtained by interpolation, then the input and the output of the gray levels are that shown as a schematic view in FIG. 5, wherein the input-output curves of the adjusted dark level interval and the bright level interval are that shown by mark 51 and 52, respectively, the input-output curve 51 of the dark level interval is higher than the line 53, the critical points 54, 55 of the curves 51, 52 are connected by the line 56, the curves 51, 52 and the line 56 form a new adjusted relation between the input and the output of the image signal. Therefore, if the dark level lookup table has P groups of dark level proportion arrays and the bright level lookup table has Q groups of bright level proportion arrays, then there are Px Q combination ways of proportion arrays, i.e. there are Px Q input-output curves for adjustment, so there are the advantages of numerous selections and elastic application. Moreover, the order of the lookup table can be set according to the demand of the resolution of the display. If the input gray level is 10 bits and the display value in proportion array is set as 12 bits, then the output gray level is 12 bits. Therefore, as long as the order of the lookup table is changed, the present invention can be applied to different displays and has the utilization value in industry.

Figure 6:
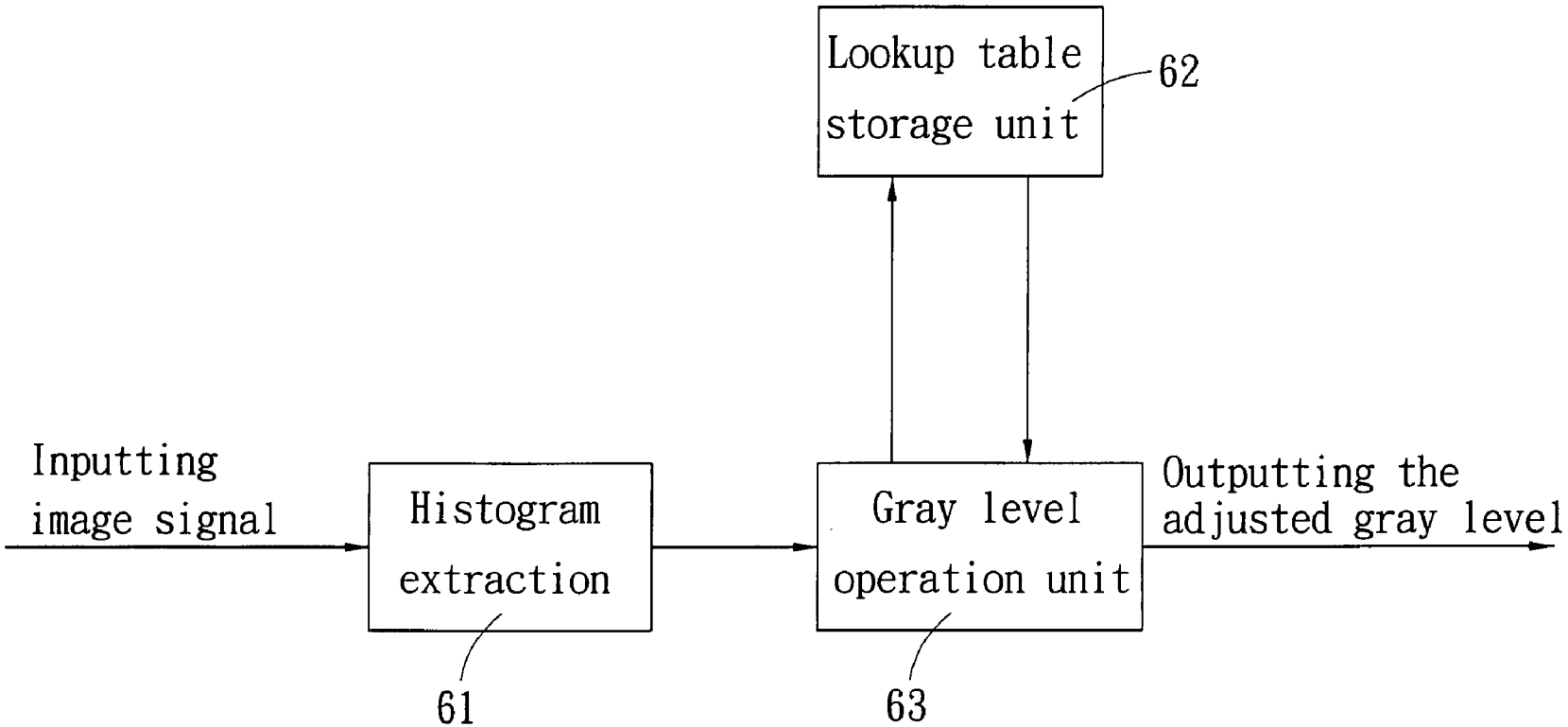
FIG. 6 is a flowchart of the image processing of the method for luminance compensation of liquid crystal display and its device according to the present invention.

Referring to FIG. 6, a device executing the above method according to the present invention includes:

A histogram extraction 61 for receiving image signals and counting the quantity distribution of each input gray level to obtain the distribution state of the gray level;

A lookup table storage unit 62 for storing the lookup table; and

A gray level operation unit for calculating the gray level proportion, taking the gray level proportion into the transfer function to get LUT intensity which corresponds to the proportion array in the lookup table, substituting the adjusted gray levels in the proportion array for the input gray levels, and outputting the adjusted gray levels; whereby the input signals are adjusted and better image quality is obtained.

Therefore, the present invention has the following advantages:

1. The disadvantages of the conventional liquid crystal display, such as insufficient luminance and contrast, can be improved and the image being enhanced has more clear contrast and more plentiful color.
2. The method of the present invention can apply to more than single panel. The particular lookup tables for different panels can be made from the different gamma curves measured from the different panels. The image adjusted according to the particular lookup table is more able to display the gradations of colors.
3. It is simple and quick that the gray levels are obtained from the lookup table by corresponding method or interpolation method, so the time for modifying the image signals can be much shortened and the image can be modified and can get the desired luminance more quickly.
4. The quantity of the proportion arrays in lookup table can be set according to the demand. The more the quantity of the group, the more the adjusted gray levels for selection. Therefore, there are the advantages of numerous selections and flexible applications.
5. The order of the lookup table can be set according to the demand of the resolution of the display, so the present invention can suit for the displays with various gray level order and has widespread applications.

The foregoing description of the preferred embodiments of this invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of this invention as defined by the accompanying claims.

What is claimed is:

1. A method for luminance compensation of liquid crystal display including the following steps:

(1) measuring an original gamma curve of a panel;

(2) setting a target gamma curve;

(3) inputting an initial gray level to obtain a luminance corresponding to the target gamma curve and finding an adjusted gray level for expressing a luminance from the original gamma curve;

(4) repeating (2) and (3) steps to produce plural groups of initial gray levels and plural groups of adjusted gray levels and set the plural groups of adjusted gray levels into a proportion array;

(5) repeating (2), (3), and (4) steps to produce plural groups of proportion arrays from different target curves and make a lookup table;

(6) calculating a quantity distribution of input gray levels of images;

(7) respectively calculating a dark level proportion and a bright level proportion;

(8) selecting a corresponding proportion array according to the value of dark level proportion from a lookup table of dark levels and substituting the adjusted gray level in the proportion array for the input gray level;

(9) selecting a corresponding proportion array according to the value of bright level proportion from a lookup table of bright levels and substituting the adjusted gray level in the proportion array for the input gray level; and

(10) outputting the adjusted gray levels for adjusting a signal intensity to improve the image quality;

whereby the method being able to adjust the input signal intensity and obtain better image quality and wherein the dark level proportion is the ratio of the gray level quantity in a dark level interval to a total gray level quantity, and the range of a dark level interval is from below a specific value in a total gray level range; the bright level proportion is the ratio of the gray level quantity in bright level interval to the total gray quantity, and the range of the bright level interval is from above a specific value in the total gray level range.

2. The method for luminance compensation of liquid crystal display as claimed in claim 1, wherein the range of the dark level interval is the front quarter of the total gray level range; the range of the bright level interval is the rear quarter of the total gray level range.

3. The method for luminance compensation of liquid crystal display as claimed in claim 1, wherein the dark level lookup table consists of a plurality of input gray levels and plural groups of proportion arrays, each input gray level can correspond to an adjusted gray level in proportion array; the bright level lookup consists of a plurality of input gray levels and plural groups of proportion arrays, each input gray level can correspond to an adjusted gray level in proportion array.

4. The method for luminance compensation of liquid crystal display as claimed in claim 1, wherein the corresponding method between dark level proportion and proportion array includes taking the dark level proportion into a dark level transfer function to get a dark level LUT intensity, the dark level LUT intensity being corresponded to the proportion array in dark level lookup table, substituting the adjusted gray level in the proportion array for the input gray level; the corresponding method between bright level proportion and proportion array includes taking the bright level proportion into a bright level transfer function to get a bright level LUT intensity, the bright level LUT intensity corresponding to the proportion array in bright level lookup table, substituting the adjusted gray level in the proportion array for the input gray level.

5. The method for luminance compensation of liquid crystal display as claimed in claim 4, wherein the dark level or the bright level transfer function is a gradually increasing function, wherein the higher the dark level or the bright level proportion, the larger the dark level or the bright level LUT intensity.

6. The method for luminance compensation of liquid crystal display as claimed in claim 1, wherein the gray levels between the adjusted gray levels are obtained by interpolation.

7. A method for luminance compensation of liquid crystal display including the following steps:

(1) calculating a quantity distribution of input gray levels of images;

(2) respectively calculating a dark level proportion and a bright level proportion;

(3) selecting a corresponding proportion array from a dark level lookup table according to the value of the dark level proportion, and substituting an adjusted gray levels in the proportion array for the input gray levels;

(4) selecting a corresponding proportion array from a bright level lookup table according to the value of the bright level proportion, and substituting adjusted gray levels in the proportion array for the input gray levels; and (5) outputting the adjusted gray levels for adjusting the signal intensity to improve the image quality;

whereby the method being able to adjust the intensity of input signals and obtain better image quality and wherein the dark level proportion is the ratio of the gray level quantity in the dark level interval to a total gray level quantity, and the range of a dark level interval is from below a specific value in a total gray level range; the bright level proportion is the ratio of the gray level quantity in the bright level interval to the total gray level quantity, and the range of the bright level interval is from above a specific value in the total gray level range.

8. The method for luminance compensation of liquid crystal display as claimed in claim 7, wherein the range of the dark level intervals is the front quarter of the total gray level range; the range of the bright level interval is the rear quarter of the total gray level range.

9. The method for luminance compensation of liquid crystal display as claimed in claim 7, wherein the dark level lookup table consists of a plurality of input gray levels and plural groups of proportion arrays, each input gray level corresponds to an adjusted gray level in the proportion array; the bright level lookup table consists of a plurality of input gray levels and plural groups of proportion arrays, each input gray level corresponds to an adjusted gray level in the proportion array.

10. The method of luminance compensation of liquid crystal display as claimed in claim 7, wherein the corresponding method between the dark level proportion and the proportion array includes: taking the dark level proportion into a dark level transfer function to obtain a dark level LUT intensity, the dark level LUT intensity corresponding to the proportion array in the dark level lookup table, substituting the adjusted gray levels in the proportion array for the input gray levels; the corresponding method between bright level proportion and the proportion array includes: taking the bright level proportion into a bright level transfer function to get a bright level LUT intensity, the bright level LUT intensity corresponding to the proportion array in the bright level lookup table, substituting the adjusted gray levels in the proportion array for the input gray levels.

11. The method for luminance compensation of liquid crystal display as claimed in claim 10, wherein the dark level, bright level transfer function is a gradually increasing function.

12. The method for luminance compensation of liquid crystal display as claimed in claim 7, wherein the gray levels between the adjusted gray levels are obtained by interpolation.

* * * * *